United States Patent [19]

Robinson et al.

[11] 4,076,111

[45] Feb. 28, 1978

[54] REGISTRATION MEANS FOR PRINTERS AND THE LIKE

[75] Inventors: Prentice I. Robinson, Pelham; Thomas T. Butterfield, Chester, both of N.H.

[73] Assignee: Centronics Data Computer Corporation, Hudson, N.H.

[21] Appl. No.: 703,623

[22] Filed: Jul. 8, 1976

[51] Int. Cl.[2] ..... B41J 3/04

[52] U.S. Cl. ..... 197/1 R; 197/66; 197/82; 101/93.05

[58] Field of Search ..... 197/1 R, 82, 66, 65, 197/19, 84, 187; 101/93.04, 93.05, 93.15; 235/61.9 R

[56] References Cited

U.S. PATENT DOCUMENTS

| | | | |
|---|---|---|---|
| 3,703,949 | 11/1972 | Howard et al. | 197/1 R |
| 3,838,250 | 9/1974 | Naas et al. | 235/61.9 R |
| 3,882,988 | 5/1975 | Sloan et al. | 197/66 |
| 3,905,463 | 9/1975 | Boyce et al. | 197/1 R |

*Primary Examiner*—Ralph T. Rader
*Attorney, Agent, or Firm*—Louis Weinstein

[57] ABSTRACT

An opaque flag mounted upon a printer carriage assembly interrupts the light emmitted by a LED from reaching a phototransistor when at the left-hand margin of the paper document. The carriage starts to move and when it reaches constant print velocity, the opaque flag moves away from the LED and the phototransistor to activate the phototransistor to trigger a gated oscillator to generate pulses of very uniform size and shape and preferably of a 50% duty cycle. The leading and trailing edges of the pulses from the gated oscillator generate strobe and delay strobe pulses of shorter pulse duration which, in turn, energize the wire actuating solenoids forming full-step and half-step dots the full-step dots creating characters within a 5 × 7 dot matrix and both the half-stepand full-step dots being forming characters within a 9 × 7 dot matrix.

When printing is completed, a PRIME signal resets and abruptly stops the gated oscillator.

The carriage is returned to the left-hand margin doing so, moving the flag between the LED and the phototransistor to decouple the drive from the carriage assembly before reaching the left-margin and enable the carriage to coast to a stop. The sequence is repeated for each line of print.

17 Claims, 7 Drawing Figures

FIG. 1a.
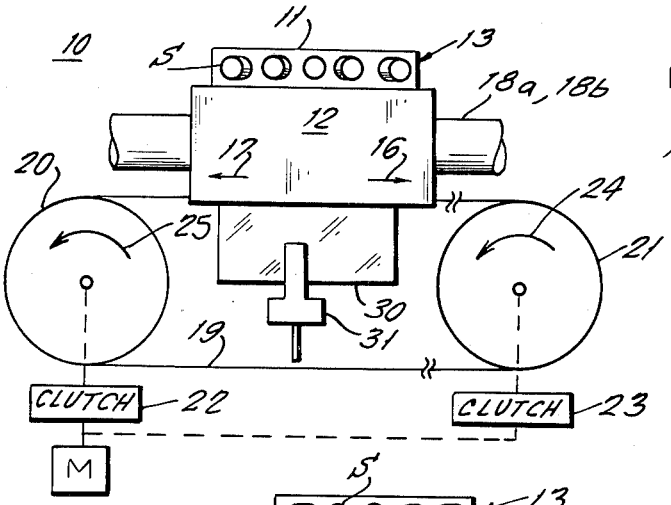
FIG. 1b.
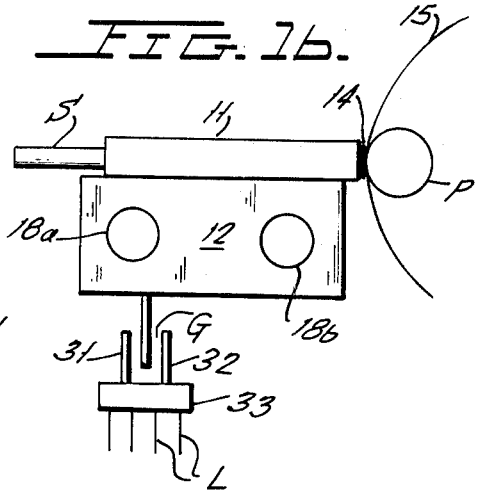
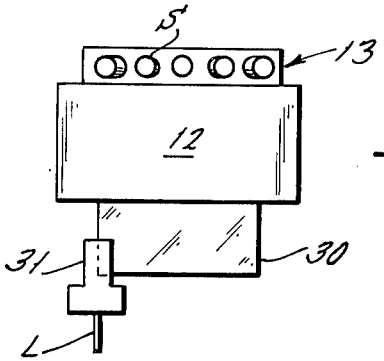
FIG. 1c.
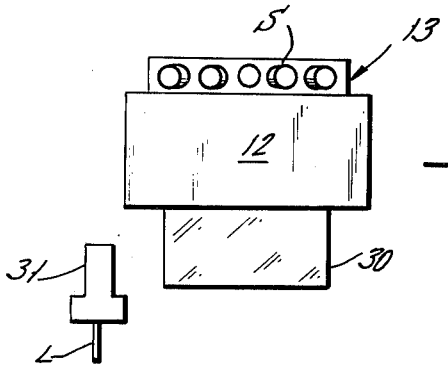
FIG. 1d.
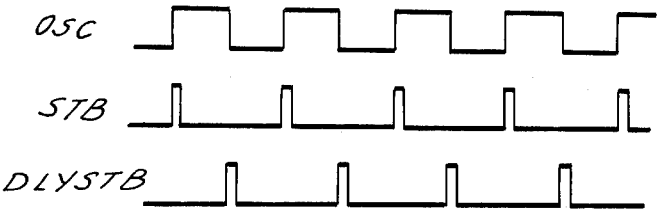
FIG. 2a.

+5V
±0V
SW9
SW8
SW3
SW2
52
53
51
50
A0
A1
A2
A3
A4
A5
A6
A7
DMC
DSCR
CO
CIP
PRIME
CLHTB2
CLHTB1
TB1
TB2
TB3
TB4
TB5
TB6
TB7
TB8
DS1
DS2
DS3
DS4
DS5
DS6
DS7
DS8
PR
D
CLR
Q
CLK
56
57
55
59
62
64
65
66
80 COLUMN
132 COLUMN
SWITCH SETTING
11110101 (175)
01111011 (223)

REGISTRATION MEANS FOR PRINTERS AND THE LIKE

BACKGROUND OF THE INVENTION

The present invention relates to line printer registration means and more particularly to a novel registration means employing a gated oscillator whose operation is accurately triggered by light sensing means.

Line printers, especially of the dot matrix type, as disclosed, for example, in U.S. Pat. No. 3,703,949, print vertically aligned dot patterns which are spaced at the desired predetermined intervals along a line of print, the appropriate positioning thereof being obtained by an elongated opaque registration strip arranged therealong and adapted to be positioned between a light sensitive device and a light source in order to develop a "video" pulse as the carriage is moved past each transparent registration slit. The output pulses developed by the phototransistor are ultimately utilized to enable the print head solenoids.

In applications wherein it is desired to provide "normal" spacing between the dot patterns forming each character and to provide "compressed" spacing so as to be able to selectively print, for example, 80 or 132 characters per line of print in the same printer, it is necessary to provide a second registration strip and a second cooperating set of lamp and phototransistor elements. Obviously, in applications wherein it is desired to provide further dot pattern concentrations of even higher densities, additional registration strips and cooperating LEDs and phototransistors must be provided, as well as requiring means for switching between and among the various registration strips, light sources and LEDs.

BRIEF DESCRIPTION OF THE INVENTION

The present invention is characterized by providing a registration technique employing a solid state gated oscillator which, due to its design, assures the proper registration spacing between and among the dot patterns; permits a simple and rapid adjustment for altering dot spacing; and avoids the need for a registration strip of varying density for each particular desired spacing.

The present invention is comprised of an LED and phototransistor mounted preferably at a position adjacent one marginal end of a paper document within the printer and spaced so as to provide a clearance path or gap therebetween. An opaque flag member is mounted for movement with the carriage assembly and is so positioned as to be movable within said gap in order to selectively interrupt light from the LED from reaching the phototransistor device.

In operation, the carriage is moved from the left-hand margin and accelerated until it reaches the constant print velocity. At a time sufficient to ensure that the carriage has been accelerated to the aforesaid constant velocity, the flag remains positioned between the LED and phototransistor and is not removed from the gap until the time that the constant print velocity is reached to thereby enable light from the LED to energize the phototransistor into conduction so as to generate a ready-to-print (RTPSW) signal which sets a bistable circuit whose Q output is coupled to the reset input of gated oscillator means thereby enabling the gated oscillator means to begin running.

Prior to generation of the RTPSW signal, i.e. prior to the setting of the bistable flip-flop circuit, the $\overline{Q}$ output maintains the gated oscillator means in the disabled state so that no oscillator pulses are generated.

As soon as the enable level appears at the $\overline{Q}$ output, the timing circuit of the gated oscillator means begins charging and the first output pulse that is developed by the gated oscillator means is available so as to immediately initiate printing. The pulse generated at the beginning of each line will be identical for each line to insure registration of dot patterns between and among the lines of print. By simple adjustment of the R-C timing elements, the printer may be adjusted to print a line of any desired print and density. Due to the precision and exact repeatability of pulses generated by the gated oscillator means, pulses developed by one-shot multivibrators triggered by the leading and trailing edges of the gated oscillator means output pulses, are very simple to produce and are precisely aligned to enable printing of "full-step" and "half-step" dot patterns employed for printing 5 × 7 and 9 × 7 dot matrix characters. By employing optical sensing means for generating the RTPSW signal the "bounce" normally encountered in mechanical switches is totally eliminated thereby further assuring accurate alignment and registration of dot patterns within each print line and between and among print lines.

Carriage return is automatically provided for by utilization of a counter in conjunction with storage means, preferably in the form of a random access memory (RAM). As each code word representing a character to be printed is transferred to the printer, the counter is incremented by one count and the count in the counter is utilized to establish the address in RAM at which the code word is to be stored. The counter is preset depending upon the number of characters to be printed per line (for example, 80 or 132) so that when the counter reaches full capacity, a signal is provided to indicate that the characters for a full line have been loaded into RAM.

Thereafter, the carriage is moved in the print direction, the gated oscillator is triggered to begin running and clock pulses derived therefrom are utilized to advance the counter thereby applying the word at each address represented by the count of the counter to the character generator means to cause sequential printing of each dot column pattern.

When the counter reaches full count capacity, the gated oscillator is reset and a carriage return operation is performed in readiness for printing the next line of characters. The preloading of the counter may be done either manually during the selection of the "normal" or "compressed" characters or may be controlled remotely for either "normal" or "compressed" characters or for printing in either of the two aforementioned formats in cases where printing only a partial line of characters is desired.

OBJECTS AND BRIEF DESCRIPTION OF THE FIGURES

It is therefore one object to provide a novel registration means for serial line printers and the like utilizing a gated oscillator for developing registration pulses.

Still another object of the present invention is to provide a registration system for serial line printers in which a normally disabled gated oscillator is enabled through the employment of an optical sensing circuit to initiate printing only after the movable print head assembly has reached normal print speed.

Still another object of the present invention is to provide a registration apparatus of the type described in the above objects wherein means are provided for simply and readily adjusting the operating frequency of the gated oscillator to provide for a commensurate change in character density.

Still another object of the present invention is to provide novel counter means utilized in combination with a random access memory for storing character codes, the counter serving the function of identifying the address of each character code as well as identifying when a full line of characters has been loaded into RAM and when a full line of characters has been printed to thereby reset the counter and initiate printing in the former case and to reset the counter and perform a carriage return operation in the latter case.

BRIEF DESCRIPTION OF THE FIGURES

The above as well as other objects of the present invention will become apparent when reading the accompanying description and drawings in which:

FIGS. 1*a* and 1*b* are front and side views respectively showing the major components of a printer embodying the principles of the present invention.

FIGS. 1*c* and 1*d* are front views of the optical sensing apparatus at various stages in the operation of the printer which are useful in describing printer operations.

FIG. 2*a* is a waveform diagram useful in describing the registration means of FIG. 2.

DETAILED DESCRIPTION OF THE INVENTION

Figure 2:
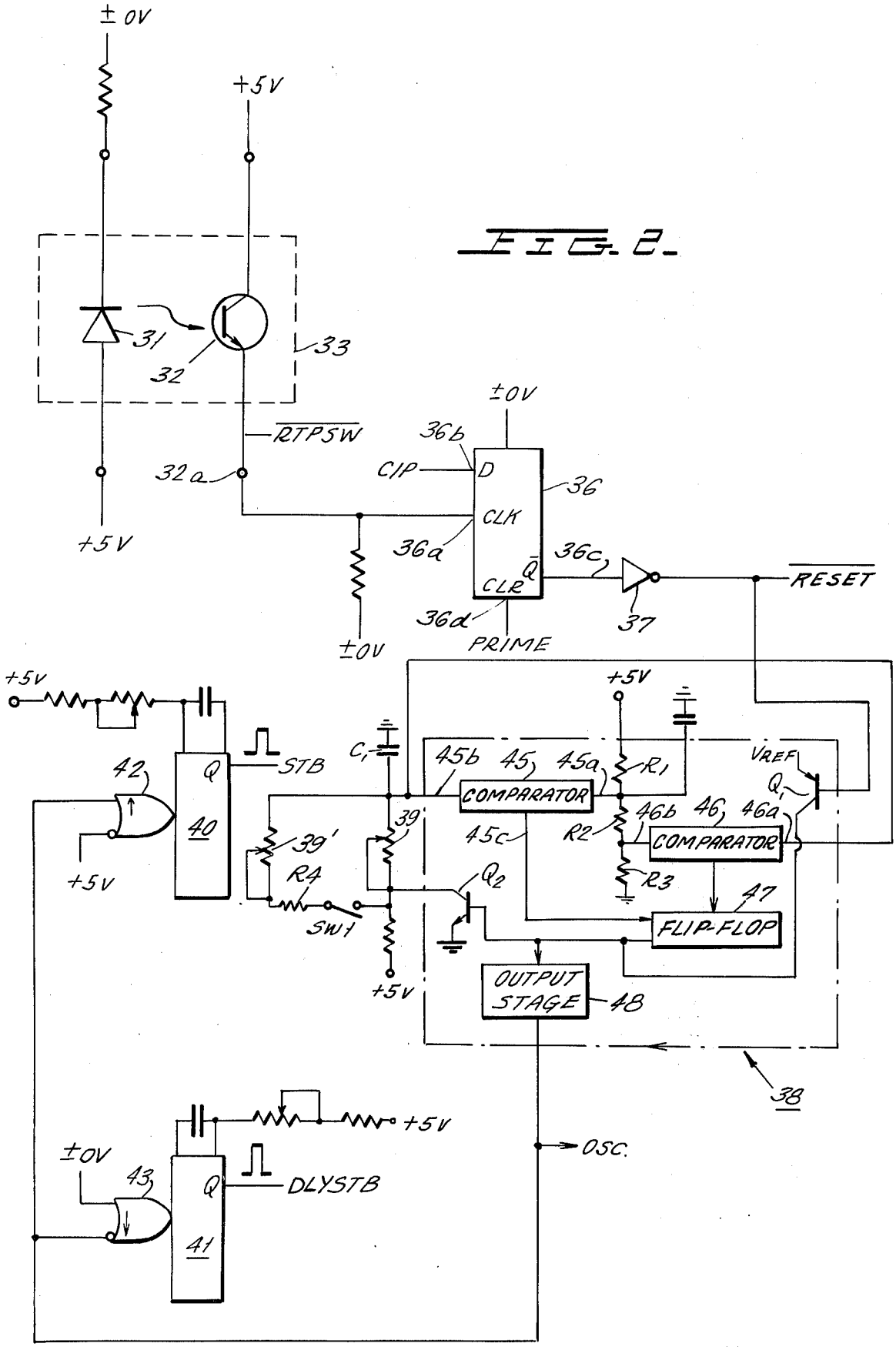
FIGS. 2 and 3 are schematics showing the electronic circuitry of the present invention.

The present invention is designed to be utilized with line printers of any type in which precision registration of characters or dot patterns is desired and more particularly is especially advantageous for use in line printers of the dot matrix type, for example, as described in U.S. Pat. No. 3,703,949. Dot matrix printers designed in accordance with the aforementioned patent typically utilize a print head assembly having print wires whose printing tips are vertically aligned and are adapted to impact an inked ribbon and a paper document by energization of print wire activating means, such as, for example, solenoids.

Typically and also as shown in FIGS. 1 and 1*a* herein, the arrangement 10 is such that the print head assembly is comprised of a housing 11 having solenoids S mounted at the rear end and having the print wires (not shown for purposes of simplicity) extending through the hollow housing and outwardly toward the front end or nose of the housing 11. By energizing the solenoids S, the print wires impact an inked ribbon 14 and a paper document 15 which is supported by a platen P.

The print head assembly 13 is mounted upon a carriage 12 capable of moving in the opposing directions 16 and 17. The carriage is guided for reciprocal movement by elongated rods 18*a* and 18*b* extending through openings in carriage 12.

The carriage assembly may typically be secured to an elongated belt, for example, a timing belt 19, which is entrained about a pair of pulleys 20 and 21. The output of motor M is selectively coupled to one of the two pulleys 20 and 21 by clutch assemblies 22 and 23 respectively. For example, by appropriate energization of clutches 22 and 23, clutch 23 is engaged to drive pulley 21 in the clockwise direction as shown by arrow 24, while clutch 22 is disengaged to enable pulley 20 to be free wheeling so as to move carriage 12 in the direction shown by arrow 16. Alternatively, clutch 23 may be energized so as to be disengaged and clutch 22 may be energized to be engaged whereupon pulley 20 is rotated in the direction shown by arrow 25 and pulley 21 is made free wheeling in order to drive the carriage assembly 12 in the direction shown by arrow 17. Obviously, other arrangements may be employed if desired, the arrangement described herein merely being one exemplary technique. For example, clutch assembly 22 may be eliminated and its function may be performed by a spring which is stretched as the carriage moves in the direction shown by arrow 16 to become charged and, by disengaging clutch assembly 23 the stretched spring takes over the movement of carriage 12 to perform a carriage return.

In order to start printing, the carriage is moved to the starting position so as to move the print wires to the left-hand margin which is the position occupied by the carriage as shown in FIG. 1*a*.

In this case, the opaque flag 30 which is mounted for movement with carriage 12, moves into the gap G between LED 31 and phototransistor 32 mounted upon support 33 and provided with electrical leads L for connection into the printer circuitry.

When the carriage assembly is moved to the lefthand position as shown in FIG. 1*a*, the opaque flag prevents light emitted from LED 31 from reaching phototransistor 32.

Figure 3:
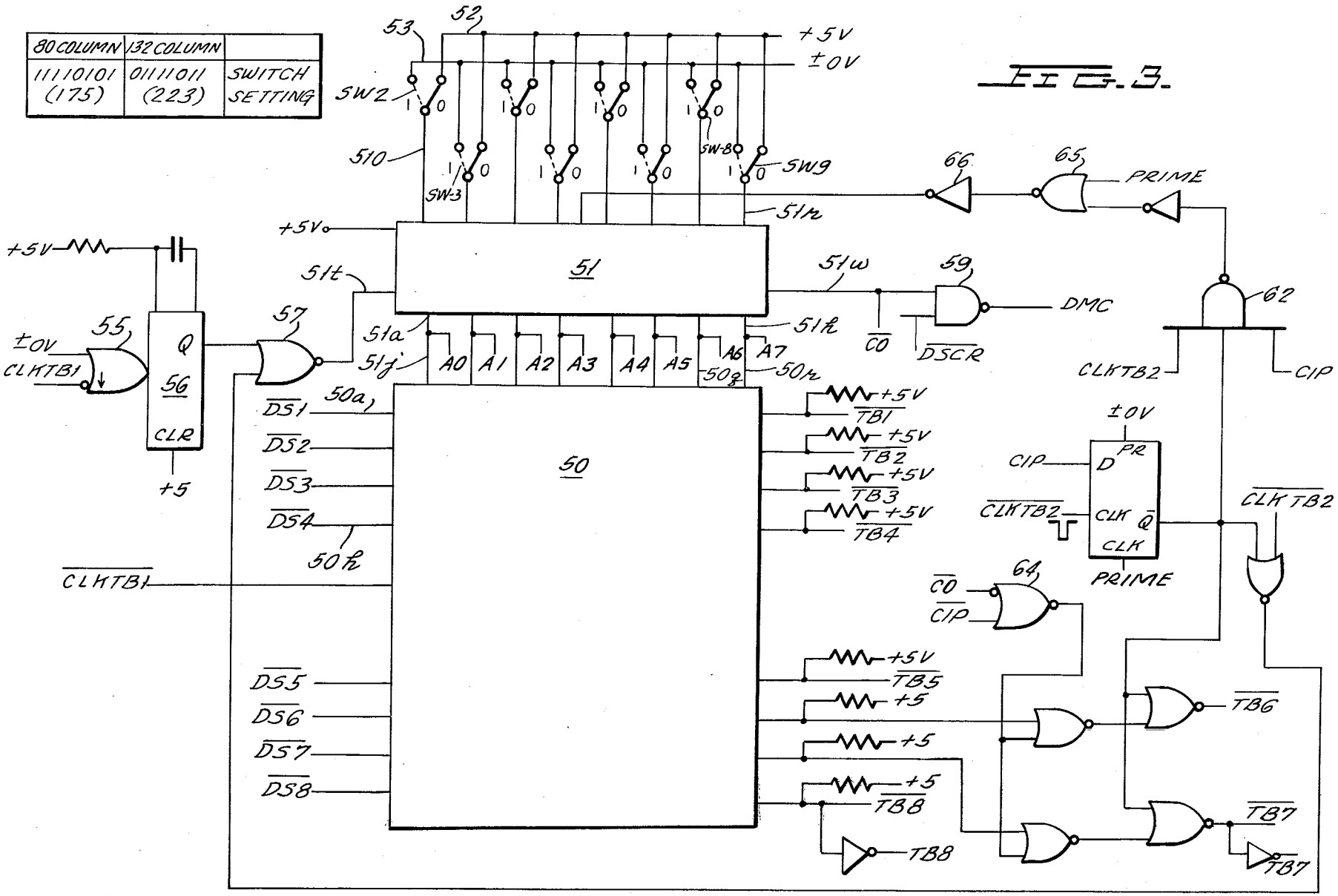

Considering the circuitry of FIG. 3, when the opaque flag is positioned therebetween, the emitter electrode 32*a* of phototransistor 32 is at logical zero.

As is described in the aforementioned U.S. Pat. No. 3,703,949, binary data for printing of a line or partial line of characters is loaded into the printer shift register. As soon as the register is loaded, a signal is developed to energize the forward clutch, for example, clutch 23 causing the carriage to begin moving in the direction shown by arrow 16. Simultaneously therewith, the signal to the forward clutch is stored by a bistable circuit. Note, for example, the bistable circuit 149 shown in FIG. 9*b* of the above mentioned U.S. Patent. This signal indicates that printing is initiated and is typically referred to as the CIP signal. When the forward clutch turns on, the signal CIP goes to a logical one and the carriage starts to move. The carriage moves from a standstill position and is accelerated preferably toward a constant print velocity. Eventually, the opaque flag 30 moves far enough so that the beam of light is no longer interrupted. When this happens the phototransistor 32 is activated causing the signal $\overline{\text{RTPSW}}$ to go to a logical one. In the logical one state, a clock signal is applied to the clock input 36*a* of a bistable flip-flop of the B-latch type which is adapted to receive the CIP signal at the D input 36*b* to clock this level into the bistable flip-flop, causing the $\overline{\text{Q}}$ output 36*c* to go to logical zero. This level is inverted by inverter 37 whose output, which is identified as the signal $\overline{\text{RESET}}$ goes to a logical one. With this signal in the logical one state, gated oscillator 38 is turned on and the signal OSC immediately begins to generate pulses at a frequency which is adjusted by the potentiometer 39. In one preferred embodiment, the OSC signal operates at a frequency of 360 pulses per second with a 50% duty cycle for printing 60 characters per second. The positive going edge of the signal OSC is employed to simultaneously fire one-shot multivibrators 40 and 41. One-shot multivibrator 40 is coupled to the oscillator signal through gate 42 so that the positive going edge of the signal OSC triggers one-shot multivibrator 40 to generate a positive going pulse identified as the signal STB (strobe). See FIG. 3*a*, 2*a*.

The negative going edge of the OSC signal is applied to gate 43 to trigger one-shot multivibrator 41 and generate a positive going pulse identified as the signal DLYSTB (delay strobe) which is employed to fire half-step dots. FIG. 2*a* shows the OSC, STB and DLYSTB waveforms.

Thus, as the printer carriage moves at a constant speed, vertical dot patterns are printed upon the occurrence of each STB signal in the case where 5 × 7 dot matrix characters are printed and vertically aligned dot patterns are printed upon the occurrence of each STB (full step dots) and DLYSTB (half-step dots) pulses to print 9 × 7 dot matrix characters.

When printing is completed, a signal PRIME is generated and this signal is applied to the clear input 36*d* of bistable flip-flop 36 (as well as other circuitry not shown herein) to "prime" all of the circuitry of the printer in readiness for printing the next line of print. When flip-flop 36 is cleared, its $\overline{Q}$ output 36*c* goes high causing the output of inverter 37 (signal $\overline{\text{RESET}}$) to go to logical zero so as to instantaneously turn off gated oscillator 38. This causes the signal OSC to go immediately to a logical zero preventing the signals STB and DLYSTB from being generated so as to prevent any printing from erroneously occurring.

When a PRIME signal occurs, the reverse clutch, for example, clutch 22, is energized and the forward clutch is deenergized causing the signal CIP to go to zero. The energization of the reverse clutch moves the carriage assembly in the direction shown by arrow 17 (FIG. 1*a*) so that the carriage eventually moves to the position shown in FIG. 2*a* whereupon the opaque flag 30 just begins to move between LED 31 and phototransistor 32.

Once the carriage moves just beyond the position shown in FIG. 1*c*, the light emitted from LED 31 is prevented from reaching the phototransistor 32 causing the signal $\overline{\text{RTPSW}}$ to go to logical zero. The signal $\overline{\text{RTPSW}}$ is utilized as one input to the reverse clutch enable gate causing the reverse clutch to be deenergized thereby enabling the carriage 12 to coast to a stop whereupon the final position of the carriage is as shown in FIG. 1*a*.

This sequence is repeated for each successive line printed by the printer.

The advantage of utilizing the optical switch arrangement (i.e. LED 31, phototransistor 32 and opaque flag 30) is that the bounce occurring in mechanical switches is eliminated and the optical switch, for all practical purposes opens and closes exactly at the same spot, which is not possible with mechanical switches.

The other advantage of the present invention is that dot column spacing can be adjusted to any desired width merely by adjustment of the potentiometer 39 to change the frequency of gated oscillator 38. For example, 132 characters can easily be printed in 80 columns, which format may be considered to be the "compressed" character format while the 80 character format may be considered to be "normal" character format.

Also, since the signal DLYSTB is fired from the negative edge of OSC, only one adjustment of potentiometer 38 has to be made and DLYSTB automatically takes care of itself. The oscillator employed herein is of a design which is very stable over temperature and can be accurately and abruptly reset. The time between the moment when the gated oscillator is turned on until the first output pulse is exactly the same time for every operation assuring, together with the optical switch arrangement, proper print alignment from line to line.

The detailed arrangement of the gated oscillator is such that when the reset input $\overline{\text{RESET}}$ input goes to logical one, Q1 causes transistor Q2 to turn off enabling capacitor C1, which forms part of the timing circuit together with potentiometer 39, to begin charging towards +5 volts. When the level at 46*a* of comparator 46 reaches the reference level at the input 46*b* of comparator 46, bistable flip-flop 47 turns Q2 on and drives output stage 48 whereupon C1 begins discharging through potentiometer 39 until it reaches a level at the input 45*b* of comparator 45 which equals a reference level at input 45*a* of comparator 45 whereupon the output 45*c* of comparator 45 resets bistable flip-flop 47 causing transistor Q2 to be turned off and altering the level applied to output stage 48. This cycle is repeated continuously so long as the $\overline{\text{RESET}}$ signal remains at logical one. As soon as the $\overline{\text{RESET}}$ signal goes to logical zero, the collector electrode of Q1 is maintained at the level $V_{ref}$, which level is applied to its emitter preventing the output of flip-flop 47 from affecting output stage 48 and maintaining Q2 in a non-conducting state.

As further shown in FIG. 2, an additional potentiometer 39' may be connected in series with resistor R4 and switch SW1, the series branch being connected in parallel across the fixed end terminals of potentiometer 39. Potentiometers 39 and 39' may be "factory adjusted" to provide the precise timing for printing "normal" and "compressed" character formats. By operating switch SW1 between the closed and open positions, the "compressed" and "normal" characters may thereby be respectively selected.

FIG. 3 shows the manner in which the printer may be adapted to identify the end of a line of print regardless of whether it be a full line or partial line. As shown in FIG. 3, 8-bit binary words are applied to the inputs 50*a*–50*h* respectively of a static memory device which may, for example, be a 4039 of the random access memory (RAM) type. The inputs 50*j*–*50r* of the RAM are applied to selected outputs of counter 51 which, in the example given, is adapted to be capable of counting from 0–255. Thus, outputs 51*a*–51*h* are respectively coupled to inputs 50*j*–50*r* of the RAM 50.

The inputs 51*j*–51*r* of counter 51 are selectively coupled between a +5 volt bus 52 and a bus 53 maintained at ground potential, by appropriate setting of the switches SW2–SW9. The manner of operation of the circuit is as follows:

Let it be assumed that it is desired to print the "normal" character format which for purposes of this example will be considered to be 80 characters per line. Switches SW2–SW9 are set so as to set the counter at a starting count of 175, the switches being arranged in the dotted line position.

Data is applied to the printer circuitry from a computer or other communications source and each binary word is applied to inputs 50*a*–50*h*. At that time a clock pulse CLKTB1 developed under control of the data source is applied to the input of gate 55 to trigger one-shot multivibrator 56 and enable gate 57 to apply a pulse to input 51*t* of counter 51 thereby advancing the count from 175 to 176. When the reverse state of the clock signal, i.e. $\overline{\text{CLKTB1}}$ is generated, the read-in enable line 50*t* of RAM 50 is triggered causing the data word appearing at that time at inputs 50*a*–50*h* to be read-in at a memory address determined by the count in counter 51 which is applied to inputs 50*j*–50*r* of RAM 50 by outputs 51*a*–51*h* respectively of counter 51. In the example given the address location is equivalent to decimal "175". As each new word appears at input 50*a*–50*h*, the clocking arrangement recited hereinbefore is repeated until the counter 51 reaches its full capacity at which time its output 51*w* is enabled causing gate 59 to develop the dummy character signal DMC which indicates that a full line of 80 characters is loaded in RAM 50. At this time printing may occur whereupon the forward clutch is energized, the signal CIP is developed and the carriage is brought into motion. The CIP signal is used to enable gate 62 to reset counter 51. Clocking now occurs under control of the signal CLKTB2 which is generated by the signal OSC. Each data character code is thus read-out from memory and applied to the character generator for converting the data code into dot patterns which are then utilized to selectively enable appropriate solenoid S of the printer assembly which are further triggered at precisely the proper time by the STB and/or DLYSTB signals.

As soon as the counter 51 reaches full capacity, the output 51*w*, together with the CIP signal, operates gate 64 to prevent any further character codes to be read out of RAM 50. These signals also cause the generation of the signal PRIME to reset counter 51 through gate 65 and inverter 66 and to instantly turn off gated oscillator 38.

The arrangement described herein may also be operated remotely by applying signals to the inputs 51*j*–51*r* of counter 51 representative of a starting count which may be any number other than a full line of 132 characters or a full line of 80 characters. The advantage of using the RAM 50 resides in the fact that the RAM need never be cleared since write-in of new data automatically clears any address location.

Although there has been described a preferred embodiment of this novel invention, many variations and modifications will now be apparent to those skilled in the art. Therefore, the invention is to be limited, not by the specific disclosure herein, but only by the appending claims.

What is claimed is:

1. Apparatus for electronically controlling the printing of a line of N dot patterns and the like on a paper document to assure proper registration of the dot patterns comprising:

a movable carriage;

a print head assembly mounted upon said carriage and including print control means for producing dot patterns;

means for moving the carriage across the paper document between the margins of said paper document at a substantially constant speed during printing;

a light source and a light sensing element arranged in spaced fashion near one of said margins;

a flag mounted upon said carriage and movable between said light source and said light sensing element to selectively interrupt light from said source from reaching said light sensitive element when positioned therebetween;

gated oscillator means;

means normally disabling said gated oscillator means and responsive to activation of said carriage moving means and said light sensitive element when said flag moves out of the region between said light source and said light sensitive element for enabling said oscillator means when said carriage is moving at said constant speed;

said oscillator means comprising R-C timing means for generating print control pulses at a constant frequency, which frequency enables printing of N equi-spaced dot patterns when said carriage is moving at said constant speed;

means coupling the output of said oscillator means to said print control means for enabling said print control means at spaced intervals determined by said print control pulses.

2. The apparatus of claim 1 wherein said R-C timing means includes switch means having at least first and second positions for providing a first shorter and a second longer time constant value for respectively printing compressed and non-compressed dot pattern groups.

3. The apparatus of claim 1 further comprising bistable flip-flop means having a control input, a clock input, a reset input and an output, means for storing character codes for the characters to be printed;

means for generating a carriage enable signal when said storage means contains the codes to be printed on a line;

said clock input being coupled to said light sensing element and said control input being coupled to said carriage enable means whereby said output generates a print enable signal level and remains set thereat to enable the oscillator means to operate in a free-running fashion when the carriage is moving in a first direction and the flag uncovers the light source.

4. The apparatus of claim 1 further comprising first and second pulse generating means responsive to the leading and trailing edges respectively of the pulses generated by said oscillator means for generating pulses of a duration significantly shorter than the duration of the pulses generated by said oscillator means for operating the print control means for an interval shorter than the interval of an oscillator pulse.

5. The apparatus of claim 3 further comprising means responsive to the completion of a line of printing for resetting said flip-flop means thereby removing said enable signal level to instantly disable said oscillator means.

6. The apparatus of claim 5 further comprising means for reversing the direction of said carriage assembly responsive to said resetting means;

said reversing means being coupled to said light sensing element for decoupling said reversing means from said carriage assembly when the flag interrupts the light from said light source to allow the carriage assembly to coast to a stop.

7. The apparatus of claim 3 wherein said gated oscillator means comprises transistor switch means responsive to a disable level different from said enable level for preventing charging of the capacitor of said R-C timing means and immediately terminate the operation of the gated oscillator means and responsive to said enable level for enabling charging of said capacitor to immediately initiate operation of said gated oscillator means whereby the gated oscillator means is always started on the same pulse and all pulses are of uniform height and duration to assure proper registration of each line of print with one another.

8. The apparatus of claim 1 wherein said light source is a light emitting diode and said light sensitive element is a phototransistor.

9. The apparatus of claim 1 wherein said flag is of a length sufficient to block the light from said source from reaching said light sensitive element for a period sufficient to enable said carriage to be accelerated to the desired constant print speed before enabling said gated oscillator means.

10. Apparatus for electronically controlling the printing of N dot patterns and the like on a paper document to assure proper registration of the dot patterns comprising:

a movable carriage;

a print head assembly mounted upon said carriage and including print control means for producing dot patterns;

means for moving the carriage across the paper document between the margins of said paper document at a substantially constant speed during printing;

a light source and a light sensing element arranged in spaced fashion and mounted upon said carriage assembly;

a flag mounted near one of said margins and movable between said light source and said light sensing element to selectively interrupt light from said source from reaching said light sensitive element;

gated oscillator means;

means normally disabling said gated oscillator means and responsive to activation of said carriage moving means and said light sensitive element for enabling said oscillator means.

said oscillator means comprising R-C timing means for generating print control pulses at a constant frequency;

means coupling the output of said oscillator means to said print control means for enabling said print control means at uniform spaced intervals determined by said print control pulses whereby the number of pulses generated causes the printing of N patterns at equi-spaced intervals along a line when said carriage is moving at said constant speed.

11. Apparatus for controlling registration of a line of dot patterns to be printed on a paper document in a dot matrix impact printer comprising:

printing means movable across the document;

normally disabled gated oscillator means;

means adjacent one margin of the document and responsive to movement of the printing means towards the opposite margin for initiating the running of said oscillator means;

the output of said oscillating means being coupled to said printing means for enabling printing at equi-spaced intervals along a line of print;

means for storing character codes representative of the line of characters to be printed;

means responsive to the oscillator means for selectively advancing character codes to character generator means;

said advancing means including counter means being incremented as each character code is advanced;

means for disabling said gated oscillator means responsive to a predetermined count in said counter means and including further means responsive thereto for returning the printing means to said one margin.

12. The apparatus of claim 11 wherein said storing means comprises random-access memory means;

the outputs of said counter means being coupled to associated inputs of said read-only memory means for selecting the character code to be transferred to said character generator means at the address generated at the output of said counter means.

13. The apparatus of claim 11 further comprising means for preloading a predetermined binary count into said counter means prior to initiation of printing;

said disabling means being responsive to a predetermined capacity count of said counter means.

14. The apparatus of claim 13 whereby said preloading means comprises switch means for manually controlling the count preloaded into said counter means.

15. The apparatus of claim 12 further comprising means for sequentially applying character codes to said random-access memory means and for advancing said counter means for storing character codes for the next line of characters at addresses determined by said counter means;

means responsive to said capacity count for terminating loading of character codes and including means for moving said printing means from said one margin.

16. The apparatus of claim 11 wherein said triggering means comprises opaque flag means movable with said printing means;

light means and phototransistor means spaced to form a predetermined gap;

said flag means being movable in said gap when said printing means is in the immediate region of one margin to block light illuminated from said light means from reaching said phototransistor means.

17. The apparatus of claim 16 wherein the length of said flag means is sufficient to interrupt light from reaching said phototransistor means until said printing means has been accelerated to constant printing speed, said flag also serving to interrupt the light from reaching said phototransistor means when said printing means is moving towards and is in the immediate region of said one margin to decouple drive to said printing means to allow the printing means to coast to a stop.

* * * * *

UNITED STATES PATENT AND TRADEMARK OFFICE

CERTIFICATE OF CORRECTION

PATENT NO. : 4,076,111

DATED : Feb. 28, 1978

INVENTOR(S) : Robinson et al

It is certified that error appears in the above-identified patent and that said Letters Patent are hereby corrected as shown below:

Page 1, in the ABSTRACT, line 12, cancel the word "the".
Page 1, in the ABSTRACT, lines 19 and 20, cancel the words "doing so".
Column 1, line 64, "Q" should read --$\bar{Q}$--.
Column 5, line 5, cancel the word "3a,".

Signed and Sealed this

*Twenty-seventh* Day of *June 1978*

[SEAL]

*Attest:*

RUTH C. MASON
*Attesting Officer*

DONALD W. BANNER
*Commissioner of Patents and Trademarks*